US009494006B2

(12) United States Patent
Mohon et al.

(10) Patent No.: US 9,494,006 B2
(45) Date of Patent: Nov. 15, 2016

(54) PRESSURE PULSE WELL TOOL

(71) Applicants: Brian Mohon, Spring, TX (US); Robert J. Costo, Jr., The Woodlands, TX (US)

(72) Inventors: Brian Mohon, Spring, TX (US); Robert J. Costo, Jr., The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 543 days.

(21) Appl. No.: 13/966,032

(22) Filed: Aug. 13, 2013

(65) Prior Publication Data

US 2014/0048283 A1 Feb. 20, 2014

Related U.S. Application Data

(60) Provisional application No. 61/683,012, filed on Aug. 14, 2012.

(51) Int. Cl.
*E21B 7/24* (2006.01)
*E21B 28/00* (2006.01)

(52) U.S. Cl.
CPC *E21B 28/00* (2013.01); *E21B 7/24* (2013.01)

(58) Field of Classification Search
CPC combination set(s) only.
See application file for complete search history.

(56) References Cited

U.S. PATENT DOCUMENTS

| | | | |
|---|---|---|---|
| 3,361,220 | A | 1/1968 | Brown |
| 3,379,261 | A | 4/1968 | Martini |
| 3,946,819 | A | 3/1976 | Hipp |
| 4,742,498 | A | 5/1988 | Barron |
| 4,865,125 | A | 9/1989 | De Cuir |
| 4,979,577 | A | 12/1990 | Walter |
| 5,467,322 | A | 11/1995 | Walter |
| 5,542,484 | A | 8/1996 | McInnes |
| 5,595,244 | A | 1/1997 | Roberts |
| 5,722,495 | A | 3/1998 | Rear |

(Continued)

FOREIGN PATENT DOCUMENTS

| | | |
|---|---|---|
| EP | 1069244 A2 | 9/2005 |
| FR | 2880060 A1 | 6/2006 |

(Continued)

OTHER PUBLICATIONS

Breyholtz, et al., "Evaluating control designs for co-ordinating pump rates and choke valve during managed pressure drilling operations", 18th IEEE Conference on Control Applications, Part of 2009 IEEE Multi-conference on Systems and Control, St. Petersburg, Russia, Jul. 8-10, 2009, 8 pages.

(Continued)

*Primary Examiner* — William P Neuder
*Assistant Examiner* — Ronald Runyan

(57) ABSTRACT

Implementations described herein are directed to a pressure pulse well tool, which may include an upper valve assembly configured to move between a start position and a stop position in a housing. The pressure pulse well tool may also include an activation valve subassembly disposed within the upper valve assembly. The activation valve subassembly may be configured to restrict a fluid flow through the upper valve assembly and increase a fluid pressure across the upper valve assembly. The pressure pulse well tool may further include a lower valve assembly disposed inside the housing and configured to receive the fluid flow from the upper valve assembly. The lower valve assembly may be configured to separate from the upper valve assembly after the upper valve assembly reaches the stop position, causing the fluid flow to pass through the lower valve assembly and to decrease the fluid pressure across the upper valve assembly.

20 Claims, 6 Drawing Sheets

(56) References Cited

U.S. PATENT DOCUMENTS

| | | | | |
|---|---|---|---|---|
| 5,740,127 | A | 4/1998 | Van Steenwyk et al. | |
| 6,029,758 | A | 2/2000 | Novacovicci et al. | |
| 6,053,261 | A | 4/2000 | Walter | |
| 6,279,670 | B1 | 8/2001 | Eddison et al. | |
| 6,460,620 | B1 | 10/2002 | LaFleur | |
| 6,666,273 | B2 * | 12/2003 | Laurel | E21B 21/10 166/320 |
| 6,675,909 | B1 | 1/2004 | Cowart et al. | |
| 6,898,150 | B2 | 5/2005 | Hahn et al. | |
| 6,986,394 | B2 | 1/2006 | Marsh | |
| 7,073,610 | B2 | 7/2006 | Susman | |
| 7,163,058 | B2 | 1/2007 | Bakke | |
| 7,264,055 | B2 | 9/2007 | Mody et al. | |
| 7,293,614 | B2 | 11/2007 | Rose | |
| 7,417,920 | B2 | 8/2008 | Hahn et al. | |
| 7,430,153 | B2 | 9/2008 | Fraser et al. | |
| 7,575,051 | B2 | 8/2009 | Stoesz et al. | |
| 7,874,364 | B2 | 1/2011 | Redlinger et al. | |
| 8,069,926 | B2 | 12/2011 | Eddison et al. | |
| 8,109,348 | B2 | 2/2012 | Lorger et al. | |
| 2003/0209349 | A1 | 11/2003 | Taylor et al. | |
| 2009/0056948 | A1 | 3/2009 | Martin et al. | |
| 2009/0183920 | A1 | 7/2009 | Hall et al. | |
| 2011/0036591 | A1 | 2/2011 | George et al. | |
| 2011/0168410 | A1 | 7/2011 | deBoer | |
| 2015/0136405 | A1 * | 5/2015 | Mohon | E21B 21/103 166/320 |

FOREIGN PATENT DOCUMENTS

| | | | |
|---|---|---|---|
| FR | 2881466 | A1 | 8/2006 |
| GB | 1097242 | A | 1/1968 |
| GB | 1245617 | A | 9/1971 |
| GB | 1248895 | A | 10/1971 |
| GB | 2338255 | A | 12/1999 |
| GB | 2355998 | A | 5/2001 |
| GB | 2443834 | A | 5/2008 |
| WO | 9819041 | A1 | 5/1998 |
| WO | 2010106406 | A2 | 9/2010 |
| WO | 2010125405 | A2 | 11/2010 |
| WO | 2011136663 | A1 | 11/2011 |

OTHER PUBLICATIONS

Dusseault, et al., "A Dynamic Pulsing Workover Approach for Wells", 8th Petroleum Conference of the South Saskatchewan Section, The Petroleum Society of CIM, Held in Regina, Oct. 18-21, 1999, 11 pages.

Fredericks, et al., "Successful Implementation of First Closed Loop, Multiservice Control System for Automated Pressure Management in a Shallow Gas Well Offshore Myanmar", SPE-112651-MS, Society of Petroleum Engineers, IADC/SPE Drilling Conference, Orlando, Florida, USA, Mar. 4-6, 2008, 18 pages.

Hongjian, et al., "Analysis on modulation principle of mechanical spring valve block-type pulse jet", ISIE 2011 Proceedings of the International Conference on Intelligence Science and Information Engineering, 2011, 4 pages.

Marsh, et al., "Measurement-While-Drilling Mud Pulse Detection Process: An Investigation of Matched Filter Responses to Simulated and Real Mud Pressure Pulses", SPE-17787-MS, Society of Petroleum Engineers, Petroleum Computer Conference, San Jose, California, Jun. 27-29, 1988, 8 pages.

Nie, et al., "A Study of a Low-Frequency Downhole Hydraulic Pulsing Cementing Device and Its Field Application", SPE 124506, SPE Annual Technical Conference and Exhibition held in New Orleans, LA, Oct. 4-7, 2009, 9 pages.

Nygaard, et al., "Modelling Two-Phase Flow for Control Design in Oil Well Drilling", Proceedings of 2005 IEEE Conference on Control Applications, toronto, Canada, Aug. 28-31, 2005, 6 pages.

Westermark, et al., "Enhanced Oil Recovery with Downhole Vibration Stimulation", SPE 67303, Osage County, Oklahoma, Mar. 24-27, 2001, 13 pages.

Yi, et al., "Mean Flow Regulation of High Frequency Combustion Control Valve Based on Pulse Width Modulation and System Identification", 2005 American Control Conference, Portland, OR, USA, Jun. 8-10, 2005, 6 pages.

* cited by examiner

PRESSURE PULSE WELL TOOL

CROSS-REFERENCE TO RELATED APPLICATIONS

This application claims benefit of U.S. provisional patent application Ser. No. 61/683,012, entitled PRESSURE PULSE WELL TOOL, filed Aug. 14, 2012, which is herein incorporated by reference.

BACKGROUND

The following descriptions and examples do not constitute an admission as prior art by virtue of their inclusion within this section.

During well drilling operations, friction of a drill string against a wellbore may be generated. In particular, horizontal sections of the wellbore may produce higher friction than vertical or directional sections of the wellbore. With the increase in friction, a weight transfer to a drill bit may not be immediately realized, rates of penetration may decline, the drill string and bit wear may be amplified, and productivity may be reduced.

Various drilling tools may be used to attenuate the friction, such as those which induce a vibration, hammering effect, or reciprocation in the drill string. For example, a shock sub may be used with a pressure pulse tool to generate an axial force at a specified frequency, causing an axial vibration which oscillates the drill string and reduces friction. To generate the axial force, the pressure pulse tool may be used to create and apply cyclical pressure pulses to a pump open area of the shock sub. In another example, the cyclical pressure pulses of the pressure pulse tool may produce a water hammering effect, causing the axial vibration needed to oscillate the drill string and reduce friction.

Certain pressure pulse tools may need an external prime mover, such as a mud motor or turbine, in order to produce the cyclical pressure pulses. Implementing these external prime movers may increase the cost and complexity of the well drilling operation. Additionally, a pressure pulse tool utilizing the external prime mover may not allow for wireline accessibility downhole of the pressure pulse tool.

SUMMARY

Described herein are implementations of various technologies for a pressure pulse well tool. In one implementation, the pressure pulse well tool may include an upper valve assembly configured to move between a start position and a stop position in a housing, where the upper valve assembly includes an upper biasing mechanism configured to bias the upper valve assembly into the start position. The pressure pulse well tool may also include an activation valve subassembly disposed within the upper valve assembly. The activation valve subassembly may be configured to restrict a fluid flow through the upper valve assembly and increase a fluid pressure across the upper valve assembly, causing the upper valve assembly to move to the stop position in response to the increase of the fluid pressure. The pressure pulse well tool may further include a lower valve assembly disposed inside the housing and configured to receive the fluid flow from the upper valve assembly, where the lower valve assembly includes a lower biasing mechanism configured to bias the lower valve assembly into contact with the upper valve assembly. The lower valve assembly may also be configured to separate from the upper valve assembly after the upper valve assembly reaches the stop position, causing the fluid flow to pass through the lower valve assembly and to decrease the fluid pressure across the upper valve assembly.

Described herein are implementations of various techniques for generating a pressure pulse. In one implementation, a method for generating a pressure pulse may include restricting a fluid flow through an upper valve assembly using an activation valve subassembly disposed within the upper valve assembly, thereby increasing a fluid pressure across the upper valve assembly. The method may include moving the upper valve assembly from a start position to a stop position in response to an increase in fluid pressure across the upper valve assembly. The method may further include separating a lower valve assembly from the upper valve assembly after the upper valve assembly moves to the stop position, thereby causing the fluid flow to pass through the lower valve assembly and to decrease the fluid pressure across the upper valve assembly.

The above referenced summary section is provided to introduce a selection of concepts in a simplified form that are further described below in the detailed description section. The summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

Implementations of various techniques will hereafter be described with reference to the accompanying drawings. It should be understood, however, that the accompanying drawings illustrate only the various implementations described herein and are not meant to limit the scope of various techniques described herein.

DETAILED DESCRIPTION

Figure 1:
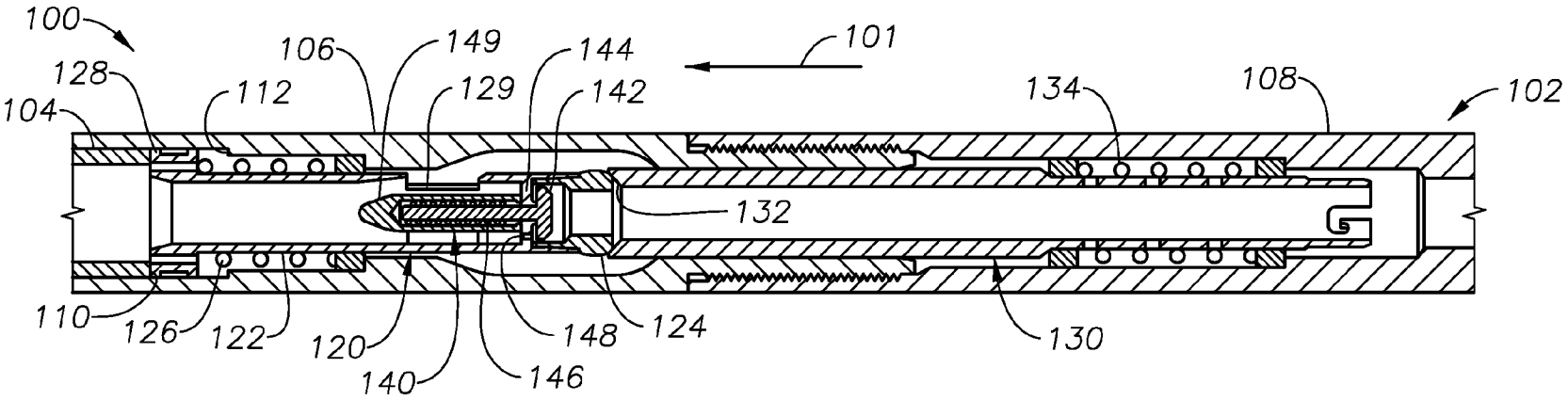
FIG. 1 illustrates a cross-sectional view of a pressure pulse well tool in accordance with implementations of various techniques described herein.

The discussion below is directed to certain specific implementations. It is to be understood that the discussion below is only for the purpose of enabling a person with ordinary skill in the art to make and use any subject matter defined now or later by the patent "claims" found in any issued patent herein.

It is specifically intended that the claimed invention not be limited to the implementations and illustrations contained herein, but include modified forms of those implementations including portions of the implementations and combinations of elements of different implementations as come within the scope of the following claims. It should be appreciated that in the development of any such actual implementation, as in any engineering or design project, numerous implementation-specific decisions must be made to achieve the developers' specific goals, such as compliance with system-related and business related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure. Nothing in this application is considered critical or essential to the claimed invention unless explicitly indicated as being "critical" or "essential."

It will also be understood that, although the terms first, second, etc. may be used herein to describe various elements, these elements should not be limited by these terms. These terms are only used to distinguish one element from another. For example, a first object or step could be termed a second object or step, and, similarly, a second object or step could be termed a first object or step, without departing from the scope of the invention. The first object or step, and the second object or step, are both objects or steps, respectively, but they are not to be considered the same object or step.

As used herein, the terms "up" and "down"; "upper" and "lower"; "upwardly" and downwardly"; "below" and "above"; and other similar terms indicating relative positions above or below a given point or element may be used in connection with some implementations of various technologies described herein. However, when applied to equipment and methods for use in wells that are deviated or horizontal, or when applied to equipment and methods that when arranged in a well are in a deviated or horizontal orientation, such terms may refer to a left to right, right to left, or other relationships as appropriate.

The following paragraphs provide a brief summary of various technologies and techniques directed at using a pressure pulse well tool described herein.

In one implementation, a pressure pulse well tool may include an upper valve assembly and a lower valve assembly disposed within a housing. The upper valve assembly may also include an upper biasing mechanism. The upper biasing mechanism may bias the upper valve assembly into a "start" position in an uphole direction such that the upper valve assembly may be seated against an upper shoulder. The lower valve assembly may include a lower biasing mechanism which may bias the lower valve assembly in the uphole direction into contact with the upper valve assembly such that a seal may be created where the lower valve assembly meets the upper valve assembly. An activation valve subassembly may be disposed within the upper valve assembly. The activation valve subassembly may include a plunger which may be movably disposed within the upper valve assembly and capable of forming a seal within upper valve assembly.

A fluid flow may pass through to the upper valve assembly. With a flow rate less than a predetermined threshold flow rate, the pressure pulse well tool may be placed in a "deactivate" state. In the "deactivate" state, the fluid flow may pass through the activation valve subassembly and through an annular restriction to the lower valve assembly. With the flow rate greater than or equal to the predetermined threshold flow rate, a fluid pressure differential across the activation valve subassembly may increase, such that the plunger may move in a downhole direction to form a seal within the upper valve assembly, placing the pressure pulse well tool in an "activate" state.

The seal formed by the plunger may restrict the fluid flow from passing through the upper valve assembly. In turn, a fluid pressure may increase across the upper valve assembly, which may lead to an increase in a pressure force acting on the upper valve assembly and an increase in a pressure force acting on the lower valve assembly.

The upper valve assembly may move away from the "start" position in the downhole direction due to a momentum of the fluid flow and the pressure force acting on the upper valve assembly, overcoming the upper biasing mechanism. Further, the lower valve assembly may overcome the lower biasing mechanism and move in conjunction with the upper valve assembly in the downhole direction due to the momentum of the fluid flow, the pressure force acting on the upper valve assembly, and the pressure force acting on the lower valve assembly. The upper valve assembly may move until reaching the "stop" position, where the upper valve assembly may be seated against a lower shoulder.

When the upper valve assembly reaches the "stop" position, the pressure force acting on the lower valve assembly may continue to move the lower valve assembly downhole. In turn, the lower valve assembly may separate from the upper valve assembly, breaking the seal where the lower valve assembly meets the upper valve assembly. The fluid flow may then pass to the lower valve assembly through the housing. As the fluid flow passes through to the lower valve assembly, the fluid pressure across the upper valve assembly may then decrease.

In turn, the upper biasing mechanism may bias the upper valve assembly back to the "start" position. Further, the lower biasing mechanism may begin to move the lower valve assembly. The lower biasing mechanism may bias the lower valve assembly into contact with the upper valve assembly such that the seal where the lower valve assembly meets the upper valve assembly may be re-created. With the flow rate of the fluid flow greater than or equal to the predetermined threshold flow rate, the pressure pulse well tool may remain in the "activate" state. The fluid pressure may again increase across the upper valve assembly, which may cause the pressure pulse well tool to again operate as described above.

One or more implementations of various techniques for using a pressure pulse well tool will now be described in more detail with reference to FIGS. 1-10 in the following paragraphs.

Pressure Pulse Well Tool

FIG. 1 illustrates a cross-sectional view of a pressure pulse well tool 100 in accordance with implementations of various techniques described herein. In one implementation, the pressure pulse well tool 100 may include a housing 102 having an upper sub 104, an upper valve cylinder 106, a lower valve cylinder 108, and a lower sub (not shown). The upper sub 104 may be coupled to the upper valve cylinder 106, the upper valve cylinder 106 may be coupled to the lower valve cylinder 108, and the lower valve cylinder 108 may be coupled to the lower sub through the use of threads, bolts, welds, or any other attachment feature known to those skilled in the art. The housing 102 may be oriented such that the upper sub 104 may engage with uphole members of a drill string, such as a shock sub, and the lower sub may engage with downhole members of the drill string.

The pressure pulse well tool 100 may also include an upper valve assembly 120 and a lower valve assembly 130 disposed within the housing 102. The upper valve assembly 120 may include an upper valve body 122 coupled to an upper valve seat 124. The upper valve assembly 120 may be oriented such that the upper valve body 122 is located uphole relative to the upper valve seat 124. The upper valve body 122 may be coupled to the upper valve seat 124 through the use of threads, bolts, welds, or any other attachment feature known to those skilled in the art.

The upper valve assembly 120 may also include an upper biasing mechanism 126. The upper biasing mechanism 126 may bias the upper valve assembly 120 in an uphole direction 101. In one implementation, the upper biasing mechanism 126 may be coupled to the upper valve body 122. The upper biasing mechanism 126 may be a coiled spring, a Belleville washer spring, or any other biasing mechanism known to those skilled in the art.

The upper biasing mechanism 126 may bias the upper valve assembly 120 into a "start" position such that the upper valve assembly 120 may be seated against an upper shoulder 110. The upper shoulder 110 may be located within a bore of the upper valve cylinder 106. In one implementation, the upper shoulder 110 may be formed by a downhole end of the upper sub 104. The upper valve body 122 may include a head section 128 having a greater outer diameter than the rest of the upper valve body 122. When the upper valve assembly 120 is in the "start" position, an uphole side of the head section 128 may be seated against the upper shoulder 110.

Movement of the upper valve assembly 120 may also be limited by a lower shoulder 112. The lower shoulder 112 may be formed by a change in diameter of the bore of the upper valve cylinder 106. The upper valve assembly 120 may be in a "stop" position when it is seated against the lower shoulder 112. In particular, a downhole side of the head section 128 may be seated against the lower shoulder 112 when the upper valve assembly 120 is in the "stop" position. In one implementation, a spacer may be coupled to the lower shoulder 112 to further limit movement of the upper valve assembly 120. The upper valve assembly 120 may also include a window 129 along the upper valve body 122, providing a channel from a bore of the upper valve body 122 to the bore of the upper valve cylinder 106.

The lower valve assembly 130 may include a lower valve seat 132 located at an uphole end of the lower valve assembly 130. The lower valve assembly 130 may also include a lower biasing mechanism 134 which may bias the lower valve assembly 130 in the uphole direction 101. The lower biasing mechanism 134 may be a coiled spring, a Belleville washer spring, or any other biasing mechanism known to those skilled in the art.

The lower biasing mechanism 134 may bias the lower valve assembly 130 into contact with the upper valve assembly 120 such that a seal may be created where the lower valve seat 132 meets the upper valve seat 124. In one implementation, a metal-to-metal seal is formed where the lower valve seat 132 meets the upper valve seat 124.

An activation valve subassembly 140 may be disposed within the upper valve assembly 120. The activation valve subassembly 140 may include a plunger 142, an activation valve centralizer 144, an activation biasing mechanism 146, one or more flow path holes 148, and a diverter sleeve 149. The activation valve subassembly 140 is described in more detail with reference to FIGS. 2 and 3.

Figure 2:
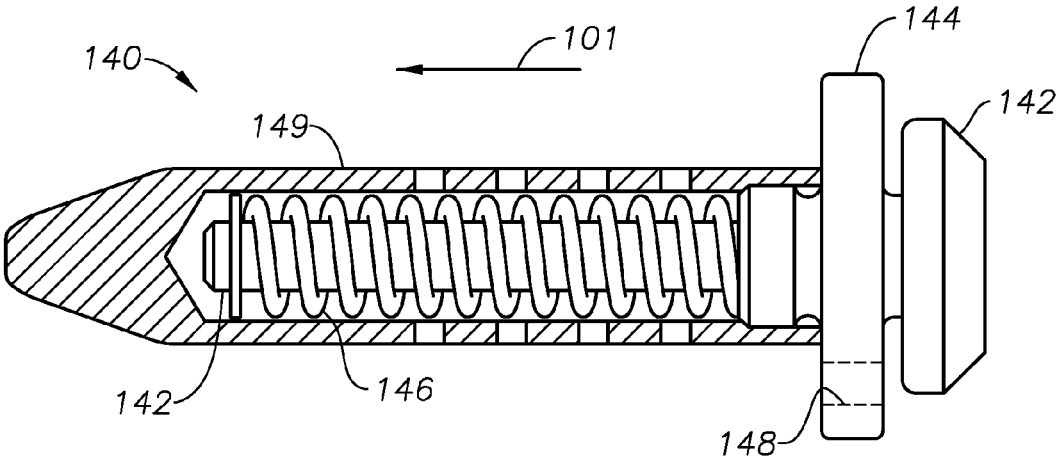
FIG. 2 illustrates a side view of an activation valve subassembly in accordance with implementations of various techniques described herein.
Figure 3:
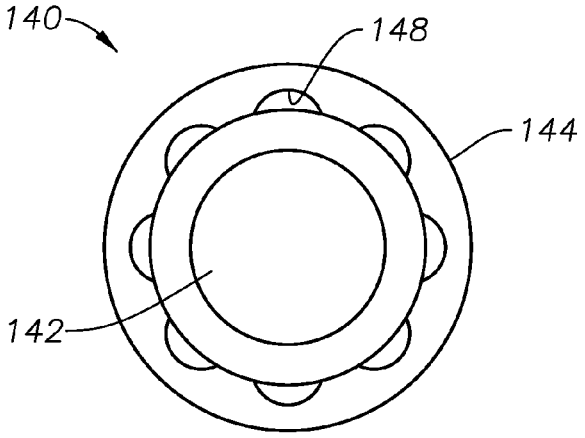
FIG. 3 illustrates a top view of an activation valve subassembly in accordance with implementations of various techniques described herein.

FIG. 2 illustrates a side view of the activation valve subassembly 140 in accordance with implementations of various techniques described herein, and FIG. 3 illustrates a top view of the activation valve subassembly 140 in accordance with implementations of various techniques described herein. The activation valve centralizer 144 may be coupled to the diverter sleeve 149 such that the plunger 142 may be movably disposed through the activation valve centralizer 144 and the diverter sleeve 149. The activation biasing mechanism 146 may bias the plunger 142 in the uphole direction 101 such that the plunger 142 may be seated against the activation valve centralizer 144. Further, the activation valve centralizer 144 may include one or more flow path holes 148.

Referring back to FIG. 1, the activation valve subassembly 140 may be oriented within the upper valve assembly 120 such that the activation valve centralizer 144 may be coupled to the bore of the upper valve body 122 and located downhole relative to the window 129. Further, the plunger 142 may be movably disposed within a bore of the upper valve seat 124 and capable of forming a seal with upper valve seat 124.

Pressure Pulse Well Tool in Operation

An operation of the pressure pulse well tool 100 will now be described with respect to FIGS. 4-9 in accordance with one or more implementations described herein.

Figure 4:
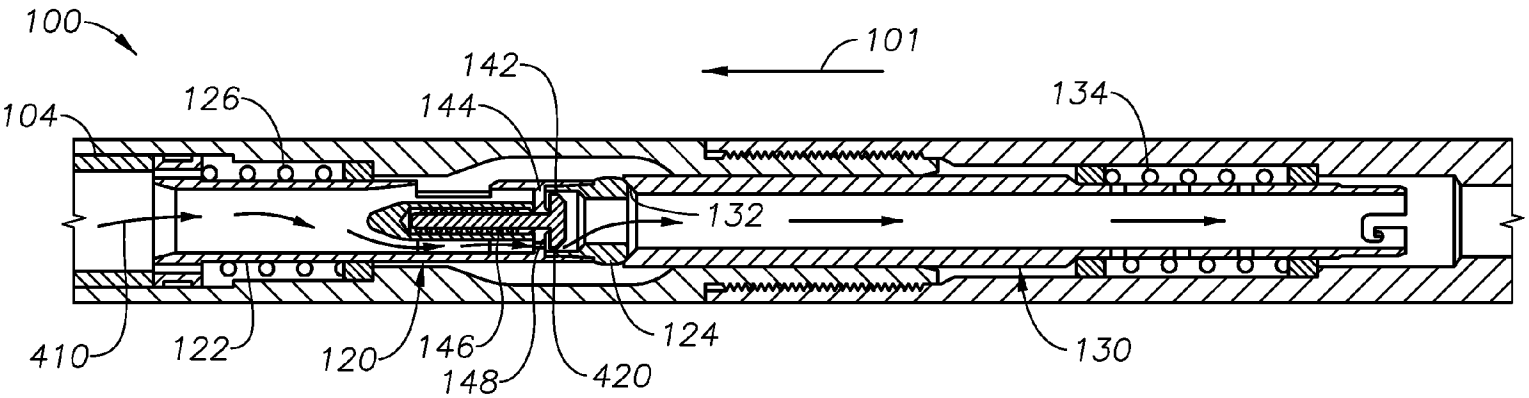
FIG. 4 illustrates a cross-sectional view of the pressure pulse well tool in a deactivate state in accordance with implementations of various techniques described herein.

FIG. 4 illustrates a cross-sectional view of the pressure pulse well tool 100 in a "deactivate" state in accordance with implementations of various techniques described herein. Initially, the upper biasing mechanism 126 may bias the upper valve assembly 120 into the "start" position. Additionally, the lower biasing mechanism 134 may bias the lower valve assembly 130 into contact with the upper valve assembly 120 such that a seal may be created where the lower valve seat 132 meets the upper valve seat 124.

A fluid flow 410 may pass from a bore of the upper sub 104 through the bore of the upper valve body 122. The fluid flow 410 may have a flow rate less than a predetermined threshold flow rate. The fluid flow 410 may include a flow of drilling fluid, drilling mud, or any other implementation known to those skilled in the art.

With the flow rate less than the predetermined threshold flow rate, the pressure pulse well tool 100 is placed in a "deactivate" state. In the "deactivate" state, the activation biasing mechanism 146 may bias the plunger 142 in the uphole direction 101 such that the plunger 142 may be seated against the activation valve centralizer 144. With the plunger 142 seated against the activation valve centralizer 144, the fluid flow 410 may pass through the one or more flow path holes 148 and through an annular restriction 420. The annular restriction 420 may be formed by an outer diameter of the plunger 142 and the bore of the upper valve seat 124.

Using the seal created where the lower valve seat 132 meets the upper valve seat 124, the fluid flow 410 may pass from the bore of the upper valve seat 124 through a bore of the lower valve assembly 130.

Figure 5:
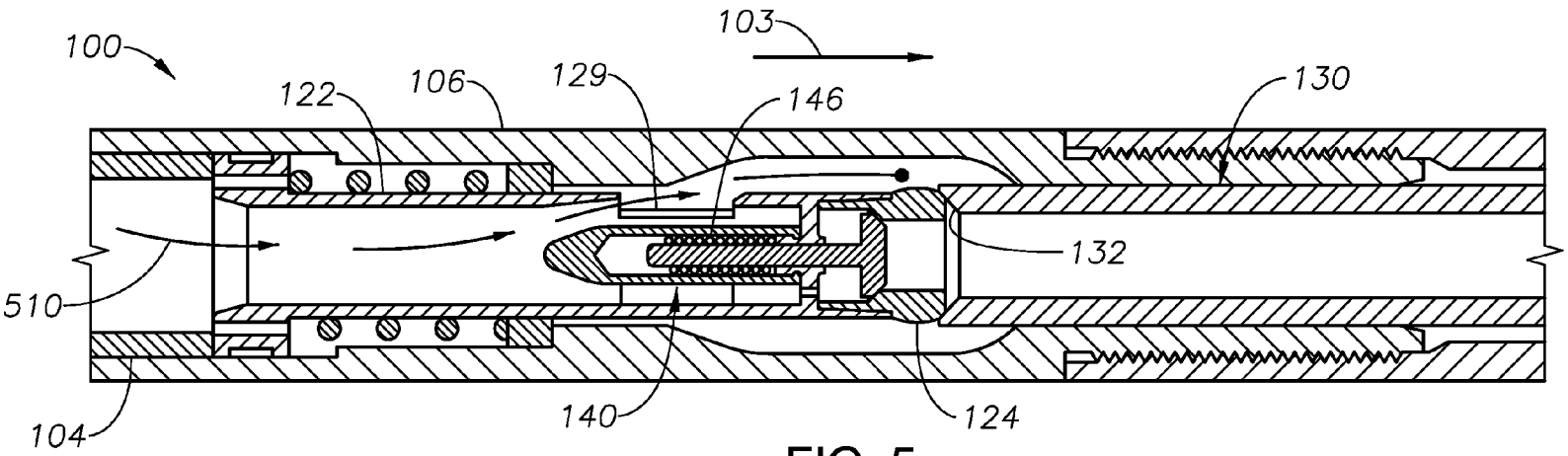
FIGS. 5-9 illustrate cross-sectional views of the pressure pulse well tool in an activate state in accordance with implementations of various techniques described herein.

FIG. 5 illustrates a cross-sectional view of the pressure pulse well tool 100 in an "activate" state in accordance with implementations of various techniques described herein. As shown in FIG. 5, a fluid flow 510 may pass from the bore of the upper sub 104 through the bore of the upper valve body 122 at a flow rate greater than or equal to the predetermined threshold flow rate. The fluid flow 510 may include a flow of drilling fluid, drilling mud, or any other implementation known to those skilled in the art. With the flow rate greater than or equal to the predetermined threshold flow rate, a fluid pressure differential across the activation valve subassembly 140 may increase, such that the plunger 142 may overcome the activation biasing mechanism 146 and move in a downhole direction 103. The plunger 142 may move until forming a seal within the bore of the upper valve seat 124, placing the pressure pulse well tool 100 in an "activate" state.

The predetermined threshold flow rate may be defined as a flow rate needed to move the plunger 142 to form the seal within the bore of the upper valve seat 124. In one implementation, the predetermined threshold flow rate may be altered by increasing or decreasing a bias of the activation biasing mechanism 146. In another implementation, the predetermined threshold flow rate may be altered by increasing or decreasing the size of the annular restriction 420.

The seal formed by the plunger 142 may restrict the fluid flow 510 from passing through the upper valve assembly 120. In particular, the fluid flow 510 may lack a fluid path from the bore of the upper valve body 122 to the bore of the lower valve assembly 130. The fluid flow 510 may then instead pass from the bore of the upper valve body 122 through the window 129. The fluid flow 510 may then deadhead in the bore of the upper valve cylinder 106 surrounding the seal created by the lower valve seat 132 meeting the upper valve seat 124. In turn, a fluid pressure may increase across the upper valve body 122, which may lead to an increase in a pressure force acting on the upper valve assembly 120 and an increase in a pressure force acting on the lower valve assembly 130.

Figure 6:
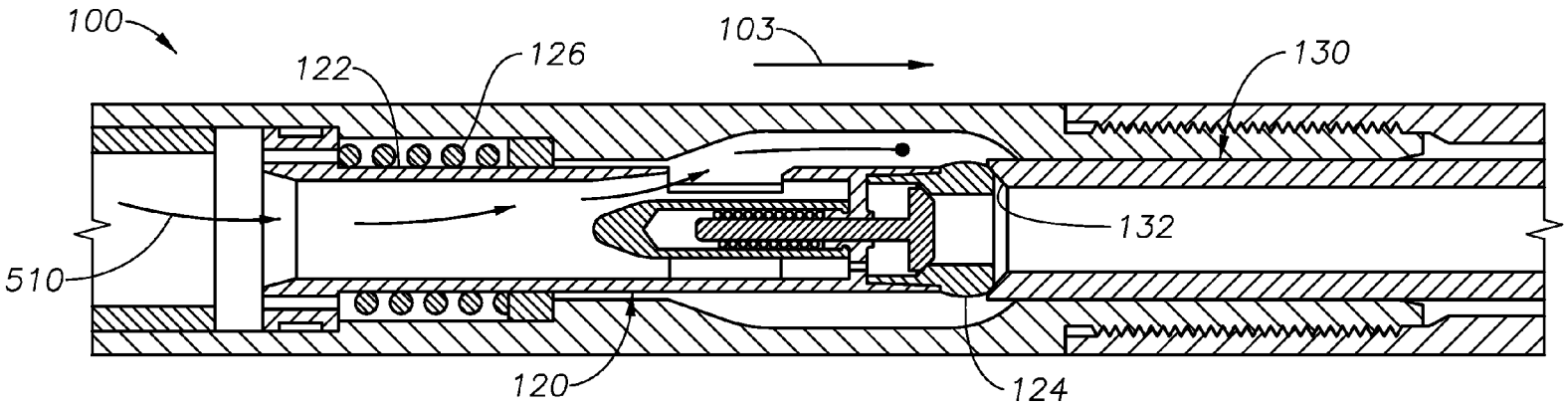

FIG. 6 illustrates a cross-sectional view of the pressure pulse well tool 100 in the "activate" state in accordance with implementations of various techniques described herein. As shown in FIG. 6, the upper valve assembly 120 may move away from the "start" position in the downhole direction 103 due to a momentum of the fluid flow 510 and the pressure force acting on the upper valve assembly 120, overcoming the upper biasing mechanism 126.

Further, the lower valve assembly 130 may overcome the lower biasing mechanism 134 and move in conjunction with the upper valve assembly 120 in the downhole direction 103 due to the momentum of the fluid flow 510, the pressure force acting on the upper valve assembly 120, and the pressure force acting on the lower valve assembly 130. The seal where the lower valve seat 132 meets the upper valve seat 124 may be maintained while the upper valve assembly 120 and the lower valve assembly 130 move in the downhole direction 103.

Figure 7:
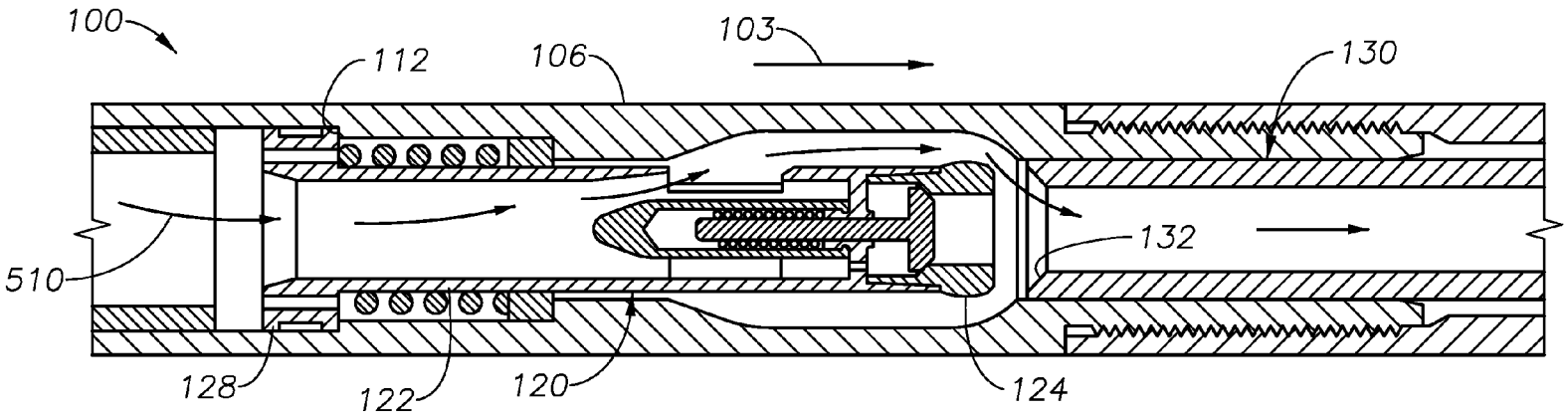

FIG. 7 illustrates a cross-sectional view of the pressure pulse well tool 100 in the "activate" state in accordance with implementations of various techniques described herein. As shown in FIG. 7, the upper valve assembly 120 may move in the downhole direction 103 until reaching the "stop" position, where the head section 128 of the upper valve body 122 may be seated against the lower shoulder 112.

When the upper valve assembly 120 reaches the "stop" position, the movement of the upper valve assembly 120 in the downhole direction 103 may be arrested. However, the pressure force acting on the lower valve assembly 130 may continue to move the lower valve assembly 130 in the downhole direction 103. In turn, the lower valve assembly 130 may separate from the upper valve assembly 120, breaking the seal where the lower valve seat 132 meets the upper valve seat 124. The fluid flow 510 may then pass from the bore of the upper valve cylinder 106 to the bore of the lower valve assembly 130. As the fluid flow 510 passes through the bore of the lower valve assembly 130, the fluid pressure across the upper valve body 122 may then decrease.

Figure 8:
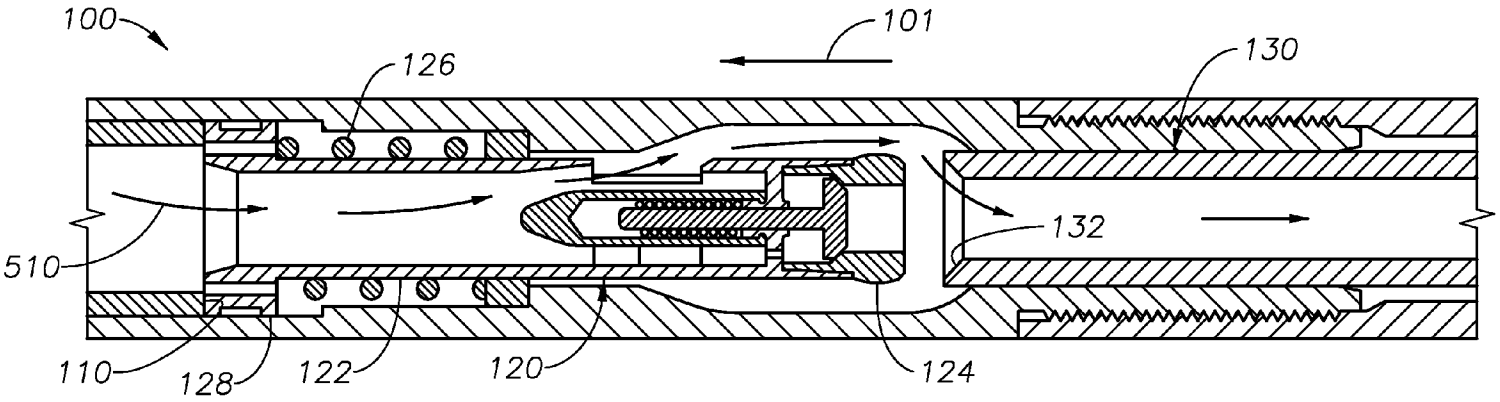

FIG. 8 illustrates a cross-sectional view of the pressure pulse well tool 100 in the "activate" state in accordance with implementations of various techniques described herein. As shown in FIG. 8, the fluid pressure across the upper valve body 122 may be relieved, leading to a decrease in the pressure force acting on the upper valve assembly 120 and a decrease in the pressure force acting on the lower valve assembly 130.

In turn, the upper biasing mechanism 126 may overcome the pressure force acting on the upper valve assembly 120 and bias the upper valve assembly 120 back to the "start" position such that the head section 128 of the upper valve body 122 may be seated against the upper shoulder 110, as illustrated in FIG. 8. In another implementation, the upper biasing mechanism 126 may bias the upper valve assembly 120 in the uphole direction 101 to a position proximate to the "start" position such that the head section 128 may be at a distance from the upper shoulder 110.

Further, the lower biasing mechanism 134 may overcome the pressure force acting on the lower valve assembly 130 and begin to move the lower valve assembly 130 in the uphole direction 101. In one implementation, the upper valve assembly 120 may return to the "start" position before the lower biasing mechanism 134 biases the lower valve assembly 130 into contact with the upper valve assembly 120. Thus, the upper valve assembly 120 may return to the "start" position before the seal, where the lower valve seat 132 meets the upper valve seat 124, is re-created.

Figure 9:
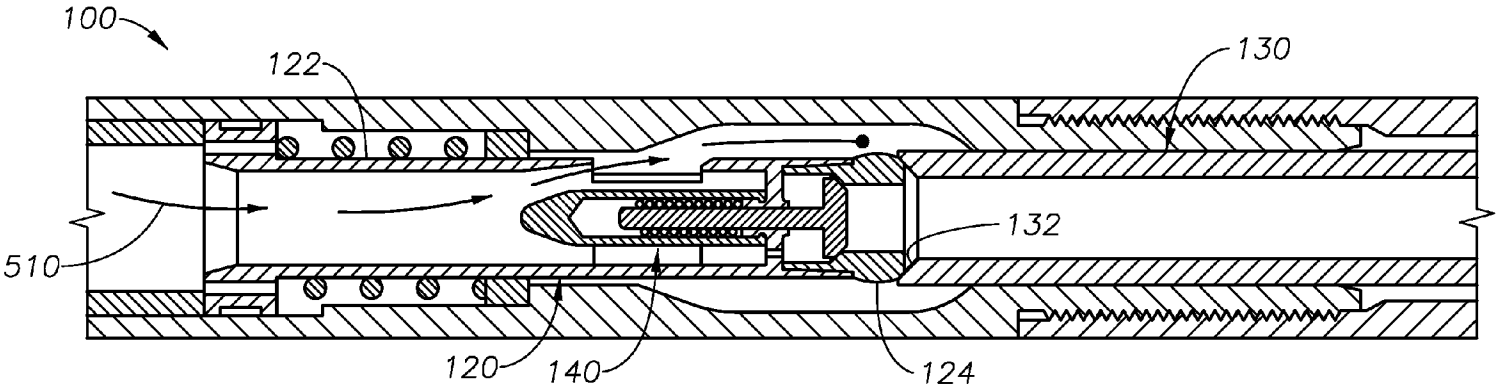

FIG. 9 illustrates a cross-sectional view of the pressure pulse well tool 100 in the "activate" state in accordance with implementations of various techniques described herein. The lower biasing mechanism 134 may bias the lower valve assembly 130 into contact with the upper valve assembly 120 such that the seal where the lower valve seat 132 meets the upper valve seat 124 may be re-created. Further, with the flow rate of the fluid flow 510 greater than or equal to the predetermined threshold flow rate, the pressure pulse well tool 100 may remain in the "activate" state. The fluid pressure may again increase across the upper valve body 122, which may cause the pressure pulse well tool 100 to again operate as described with respect to FIGS. 5-9. In operating as described above, the pressure pulse well tool 100 may produce a cyclical increase and decrease in fluid pressure across the upper valve assembly 120. In one or more implementations, the predetermined threshold flow rate may range from about 100 to about 200 gallons per minute, from about 125 to about 175 gallons per minute, or from about 140 to about 160 gallons per minute. In one implementation, the predetermined threshold flow rate may be equal to about 150 gallons per minute.

Pressure Pulse Well Tool Applications

In one implementation, the pressure pulse well tool 100 may be arranged and designed to fully operate downhole solely using fluid flow from the surface, such as through surface pumps and the like. In such an implementation, the pressure pulse well tool 100 may operate without the use of a downhole positive displacement motor or turbine to generate the fluid flow.

Figure 10:
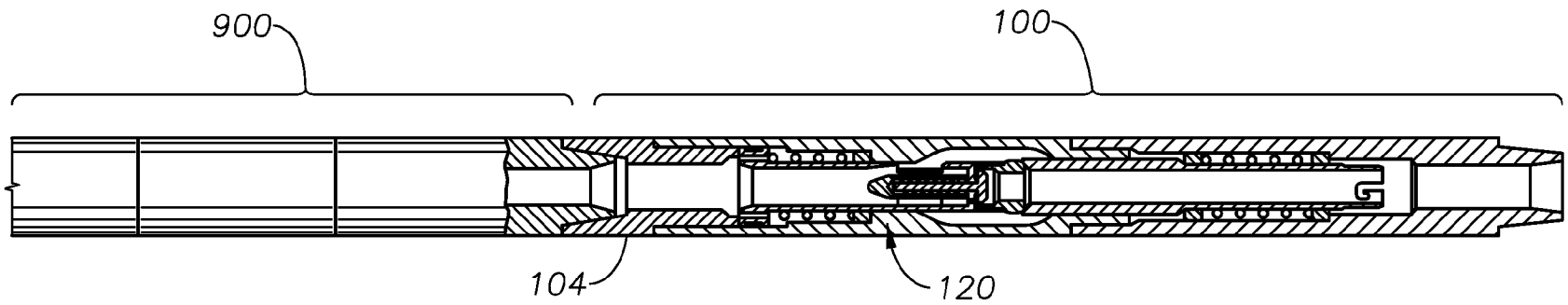
FIG. 10 illustrates a cross-sectional view of the pressure pulse well tool engaged with a shock sub in accordance with implementations of various techniques described herein.

The cyclical increase and decrease in fluid pressure across the upper valve assembly 120 of the pressure pulse well tool 100, as described earlier with respect to FIGS. 1-9, may be applied to tools which use pressure pulses. FIG. 10 illustrates a cross-sectional view of the pressure pulse well tool 100 engaged with a shock sub 900 in accordance with implementations of various techniques described herein. In one implementation, the pressure pulse well tool 100 and the shock sub 900 may be placed in a drill string for use in well drilling. The pressure pulse well tool 100 and the shock sub 900 may be oriented such that the shock sub 900 is uphole relative to the pressure pulse well tool 100. The upper sub 104 of the pressure pulse well tool 100 may be coupled to a downhole end of the shock sub 900 through the use of threads, bolts, welds, or any other attachment feature known to those skilled in the art.

The cyclical increase and decrease in fluid pressure across the upper valve assembly 120 of the pressure pulse well tool 100 produces pressure pulses which may travel through the upper sub 104. From the upper sub 104, the pressure pulses may be applied to a pump open area of the shock sub 900. In turn, the application of the pressure pulses to the pump open area may generate axial force pulses within the shock sub 900. The axial force pulses produced within the shock sub 900 may cause an axial vibration which oscillates the drill string and reduces friction.

In another implementation, the pressure pulse well tool 100 may be used without a shock sub in coil tubing applications. In such an implementation, the pressure pulses produced by the pressure pulse tool 100 may generate a water hammering effect, such that the pressure pulses may cause an axial vibration which travels up and down a drill string. In turn, the axial vibration may oscillate the drill string and reduce friction.

The pressure pulse tool 100 may generate pressure pulses which vary in amplitude, depending on physical dimensions of components of the pressure pulse well tool 100. For example, the pressure pulses may vary in amplitude by 200-350 pounds per square inch (psi). In one or more implementations, the pressure pulse tool 100 may generate pressure pulses at a rate ranging from 15 to 60 hertz (Hz). In one implementation, pressure pulse tool 100 may generate pressure pulses at a rate of about 40 hertz (Hz). In a further implementation, the pressure pulse tool 100 may be placed along a drill string in a vertical, horizontal, or directional orientation.

While the foregoing is directed to implementations of various techniques described herein, other and further implementations may be devised without departing from the basic scope thereof, which may be determined by the claims that follow. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A pressure pulse well tool, comprising:

an upper valve assembly configured to move between a start position and a stop position in a housing, wherein the upper valve assembly comprises an upper biasing mechanism configured to bias the upper valve assembly into the start position;

an activation valve subassembly disposed within the upper valve assembly, wherein the activation valve subassembly is configured to move to restrict a fluid flow through the upper valve assembly and increase a fluid pressure across the upper valve assembly, thereby causing the upper valve assembly to move to the stop position in response to the increase of the fluid pressure; and a lower valve assembly disposed inside the housing and configured to receive the fluid flow from the upper valve assembly, wherein the lower valve assembly comprises a lower biasing mechanism configured to bias the lower valve assembly into contact with the upper valve assembly, and wherein the lower valve assembly is configured to separate from the upper valve assembly after the upper valve assembly reaches the stop position, thereby causing the fluid flow to pass through the lower valve assembly and to decrease the fluid pressure across the upper valve assembly.

2. The pressure pulse well tool of claim 1, wherein the upper biasing mechanism is configured to bias the upper valve assembly in an uphole direction, and wherein the lower biasing mechanism is configured to bias the lower valve assembly in the uphole direction.

3. The pressure pulse well tool of claim 1, wherein the upper valve assembly is in the start position when seated against an upper shoulder of the housing, and wherein the upper valve assembly is in the stop position when seated against a lower shoulder of the housing.

4. The pressure pulse well tool of claim 1, wherein the lower biasing mechanism is configured to bias a lower valve seat of the lower valve assembly into forming a seal with an upper valve seat of the upper valve assembly.

5. The pressure pulse well tool of claim 1, wherein the activation valve subassembly is configured to allow the fluid flow to pass through the upper valve assembly when a flow rate of the fluid flow is less than a predetermined threshold flow rate and to restrict fluid flow through the upper valve assembly when the flow rate is greater than or equal to the predetermined threshold flow rate.

6. The pressure pulse well tool of claim 5, wherein the fluid flow through the upper valve assembly passes through an annular restriction in the upper valve assembly, the annular restriction being positioned around at least a portion of the activation valve subassembly.

7. The pressure pulse well tool of claim 6, wherein the annular restriction is formed by an outer diameter of a plunger of the activation valve subassembly and a bore of the upper valve assembly.

8. The pressure pulse well tool of claim 5, wherein the lower and upper valve assemblies are configured such that the decrease of the fluid pressure across the upper valve assembly in response to separation of the lower valve assembly from the upper valve assembly causes the upper biasing member to overcome the fluid pressure across the upper valve assembly and to move the upper valve assembly toward the start position.

9. The pressure pulse well tool of claim 5, wherein the activation valve subassembly comprises:

a plunger configured to form a seal within the upper valve assembly; and an activation biasing mechanism, wherein the plunger is configured to overcome a bias of the activation biasing mechanism to form the seal when the flow rate is greater than or equal to the predetermined threshold flow rate.

10. The pressure pulse well tool of claim 1, wherein the upper valve assembly is configured to overcome a bias of the upper biasing mechanism when moving from the start position to the stop position in a downhole direction.

11. The pressure pulse well tool of claim 1, wherein the lower valve assembly is configured to move in conjunction with the upper valve assembly in a downhole direction when the upper valve assembly moves from the start position to the stop position.

12. The pressure pulse well tool of claim 11, wherein the lower valve assembly is configured to maintain a seal with the upper valve assembly when the upper valve assembly moves from the start position to the stop position.

13. The pressure pulse well tool of claim 11, wherein the lower valve assembly is configured to overcome a bias of the lower biasing mechanism when moving in conjunction with the upper valve assembly.

14. The pressure pulse well tool of claim 1, wherein the upper biasing mechanism is configured to return the upper valve assembly to the start position in response to the lower valve assembly separating from the upper valve assembly.

15. The pressure pulse well tool of claim 14, wherein the lower biasing mechanism is configured to reestablish contact with the upper valve assembly in response to the upper valve assembly returning to the start position.

16. A method for generating a pressure pulse, comprising:

(a) restricting a fluid flow through an upper valve assembly by moving an activation valve subassembly disposed within the upper valve assembly, the movement of the activation valve subassembly increasing a fluid pressure across the upper valve assembly;

(b) moving the upper valve assembly from a start position to a stop position in response to the increase in fluid pressure across the upper valve assembly; and (c) separating a lower valve assembly from the upper valve assembly after the upper valve assembly moves to the stop position, thereby causing the fluid flow to pass through a bore within the lower valve assembly and to decrease the fluid pressure across the upper valve assembly.

17. The method of claim 16, further comprising:

moving the activation valve subassembly and thereby restricting the fluid flow through the upper valve assembly when a flow rate of the fluid flow is greater than or equal to a predetermined threshold flow rate.

18. The method of claim 17, further comprising:

after separating the lower valve assembly from the upper valve assembly and while maintaining the fluid flow greater than or equal to the predetermined threshold flow rate:

moving the upper valve assembly to the start position using an upper biasing mechanism; and moving the lower valve assembly into contact with the upper valve assembly using a lower biasing mechanism.

19. The method of claim 16, further comprising:

maintaining a seal between the lower valve assembly and the upper valve assembly when moving the upper valve assembly from the start position to the stop position.

20. The method of claim 16, further comprising:

(d) moving the upper valve assembly from the stop position to the start position in response to a decrease in fluid pressure across the upper valve assembly; and (e) moving the lower valve assembly into contact with the upper valve assembly after the upper valve assembly returns to the start position; and (f) repeating (a)-(e) while a flow rate of the fluid flow remains greater than or equal to a predetermined threshold flow rate.

* * * * *